US007949459B2

(12) United States Patent
Yoshikawa et al.

(10) Patent No.: US 7,949,459 B2
(45) Date of Patent: May 24, 2011

(54) CONTROL APPARATUS FOR VEHICLE

(75) Inventors: Hisayo Yoshikawa, Nagoya (JP); Shigeru Kamio, Nagoya (JP); Masahiro Ito, Toyota (JP); Kenji Kasashima, Nishikamo-gun (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 756 days.

(21) Appl. No.: 11/922,135

(22) PCT Filed: Jan. 18, 2007

(86) PCT No.: PCT/JP2007/051120

§ 371 (c)(1),
(2), (4) Date: Dec. 13, 2007

(87) PCT Pub. No.: WO2007/088761

PCT Pub. Date: Aug. 9, 2007

(65) Prior Publication Data

US 2010/0049419 A1 Feb. 25, 2010

(30) Foreign Application Priority Data

Jan. 31, 2006 (JP) ..... 2006-022655

(51) Int. Cl.

| | |
|---|---|
| ***G06F 19/00*** | (2006.01) |
| ***F02D 11/10*** | (2006.01) |
| ***F02D 41/14*** | (2006.01) |
| ***F02D 35/00*** | (2006.01) |

(52) U.S. Cl. ..... 701/103; 701/110; 123/399

(58) Field of Classification Search ..... 123/350, 123/352, 361, 396, 399, 403; 701/101–103, 701/110, 114, 115; 702/182, 183
See application file for complete search history.

(56) References Cited

U.S. PATENT DOCUMENTS

| | | | | |
|---|---|---|---|---|
| 5,041,981 | A | 8/1991 | Sekozawa et al. | |
| 5,559,835 | A * | 9/1996 | Betts | 375/265 |
| 5,906,185 | A * | 5/1999 | Ishida et al. | 123/399 |
| 6,014,955 | A * | 1/2000 | Hosotani et al. | 123/399 |
| 6,349,700 | B1 * | 2/2002 | Buckland et al. | 123/352 |
| 6,718,943 | B1 * | 4/2004 | De La Salle et al. | 123/399 |
| 6,832,136 | B2 | 12/2004 | Huber et al. | |
| 2005/0021219 | A1 | 1/2005 | Hartmann et al. | |
| 2007/0068489 | A1 | 3/2007 | Osumi et al. | |

FOREIGN PATENT DOCUMENTS

| | | |
|---|---|---|
| DE | 197 41 086 | 3/1999 |
| JP | 5-96922 | 4/1993 |
| JP | 11-022515 | 1/1999 |
| JP | 2002-309990 | 10/2002 |

OTHER PUBLICATIONS

Japanese Office Action dated May 18, 2010, issued in corresponding Japanese Application No. 2006-022655, with English translation.
Chinese Office Action dated Oct. 16, 2009, issued in corresponding Chinese Application No. 200780000629.4, with English translation.
International Search Report for PCT/JP2007/051120 mailed Jul. 9, 2007.

* cited by examiner

*Primary Examiner* — Willis R Wolfe, Jr.
(74) *Attorney, Agent, or Firm* — Nixon & Vanderhye P.C.

(57) ABSTRACT

A target throttle opening degree computing device of a control apparatus computes a target throttle opening degree of a throttle valve and includes a phase lead compensator. A filter filters the target throttle opening degree to provide an ultimate target throttle opening degree, which is used to drive a drive motor to adjust an opening degree of the throttle valve.

4 Claims, 8 Drawing Sheets

CONTROL APPARATUS FOR VEHICLE

This application is the U.S. national phase of International Application No. PCT/JP2007/051120 filed 18 Jan. 2007 which designated the U.S. and claims priority to Japanese Application No. 2006-22655 filed 31 Jan. 2006, the entire contents of each of which are hereby incorporated by reference.

TECHNICAL FIELD

The present invention relates to a control apparatus, which controls a control subject of a vehicle and includes a phase lead compensator and a noise filter.

BACKGROUND ART

For example, Japanese Unexamined Patent Publication No. H11-22515 discloses an electronic engine control system of a vehicle, which achieves a relatively good engine response upon driver's operation of an accelerator and thereby implements relatively good drivability of the vehicle. In this engine control system, a demanded torque (a target torque), which is demanded by the driver, is computed based on an accelerator opening degree and an engine rotational speed. Then, a target throttle opening degree (a target cylinder air charge quantity) of a throttle valve is computed based on the target torque, and an actual throttle opening degree of the throttle vlave is controlled to the target throttle opening degree. This control system includes a phase lead compensator, which compensates a charging delay of intake air, which has passed through the throttle valve.

Furthermore, Japanese Unexamined Patent Publication No. 2002-309990 recites another system, which includes a feedback control system (a closed loop system) that compensates a target throttle opening degree through a feedback operation based on a difference between a target cylinder air charge quantity and an estimative actual cylinder air charge quantity.

As described above, the control system, which controls the throttle opening degree (the cylinder air charge quantity), includes the phase lead compensator that compensates the charging delay of the intake air, which has passed the throttle valve. Thus, when a noise is added to an input of the control system, the system becomes unstable due to the phase lead compensator.

To address this disadvantage, a noise filter is applied to the input of the control system. Through use of this filter, in the steady operational period of the engine, the phase lead compensation becomes zero (or the phase lead compensation is forcefully changed to zero in the steady operational period of the engine), and thereby the system is stabilized. However, the recent study of the inventors of the present invention reveals that the control state becomes unstable in a moderate transient operational period of the engine due to influences of the following fluctuations (1) and (2) to cause hunting of the target throttle opening degree.

(1) Fluctuations of the target cylinder air charge quantity per unit time.

(2) Fluctuations of a computed value (a map value) of a charging efficiency $\eta$, which is caused by fluctuations of, for example, the engine rotational speed and the valve timing.

In this case, the fluctuations during the computation will not cause a substantial problem. However, when the target throttle opening degree shows the hunting, the motor of the electronic throttle system will be operated according to the hunting target value. Thus, the unnecessary operation is performed. This unnecessary operation may result in, for example, the deteriorated fuel consumption, the deteriorated durability of the electronic throttle system and the deteriorated drivability of the vehicle.

As described above, the control system, which includes the phase lead compensator, is sensitive to the noise applied to the input of the control system. Thus, the noise filter is applied to the input of the control system to achieve the stability of the control system. However, the input of the control system includes not only the target cylinder air charge quantity but also other operational parameters (e.g., the engine rotational speed, the valve timing), which may have negative influences on the charging efficiency $\eta$. Thus, when the filter needs to be applied to each of the hunting factors, the multiple filters need to be applied. This results in the deterioration in the response. That is, the filter acts as a phase lag compensator. Thus, when the number of the filters is increased further, the response is delayed further.

DISCLOSURE OF THE INVENTION

The present invention is made in view of the above disadvantages. Thus, it is an objective of the present invention to provide a control apparatus of a vehicle, which can achieve both of a relatively good response and a relatively good stability of a control subject even in a moderate transient operational period of the control subject.

To achieve the objective of the present invention, there is provided a control apparatus that controls a control subject of a vehicle. The control apparatus includes a phase lead compensator and a noise filter. The phase lead compensator performs phase lead compensation. The noise filter is positioned between the phase lead compensator and the control subject.

BRIEF DESCRIPTION OF THE DRAWINGS

The invention, together with additional objectives, features and advantages thereof, will be best understood from the following description, the appended claims and the accompanying drawings in which:

BEST MODES FOR CARRYING OUT THE INVENTION

An embodiment of the present invention, which is implemented in a control system that controls an electronic throttle system, will be described with reference to the accompanying drawings.

Figure 1:
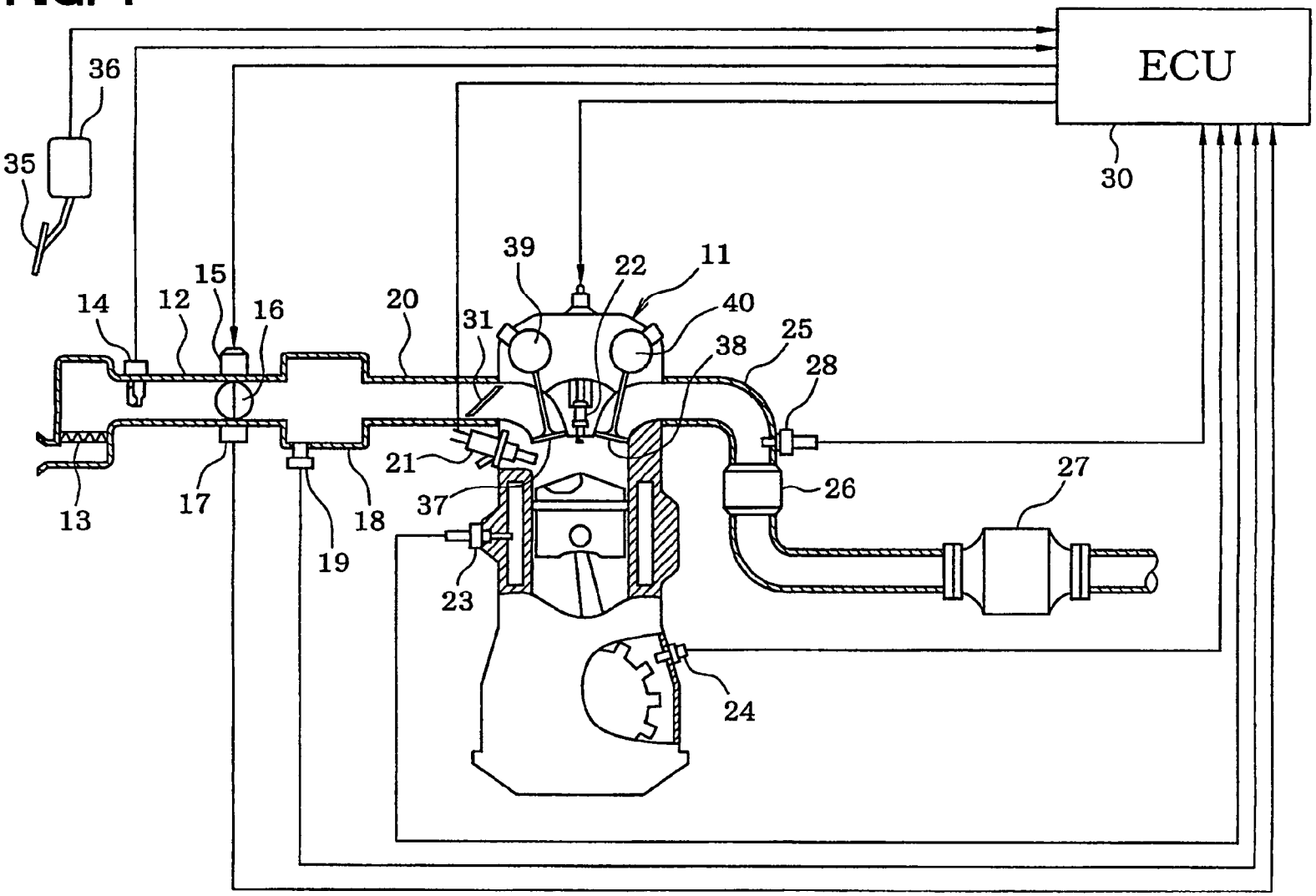
FIG. 1 is a schematic view showing a structure of an engine control system according to an embodiment of the present invention.

First, a schematic structure of an engine control system will be described with reference to FIG. 1. An air cleaner 13 is provided to an upstream end of an intake air pipe 12 of a cylinder injection type internal combustion engine 11, and an air flow meter 14, which senses an intake air quantity, is provided on a downstream side of the air cleaner 13. A throttle valve 16 and a throttle opening degree sensor 17 are provided on a downstream side of the air flow meter 14. An opening degree (a throttle opening degree) of the throttle valve 16 is adjusted through a drive motor 15 of the electronic throttle system, and the throttle opening degree sensor 17 senses the throttle opening degree of the throttle valve 16.

A surge tank 18 is provided on a downstream side of the throttle valve 16, and an intake air pipe pressure sensor 19, which senses an intake air pipe pressure, is provided to the surge tank 18. Furthermore, an intake manifold 20, which conducts air to the respective cylinders of the engine 11, is connected to the surge tank 18. Also, each of the conductive passage parts of the intake manifold 20, which are connected to the cylinders, respectively, is provided with a flow control valve 31 that controls a gas flow strength (a swirl flow strength, a tumble flow strength) in the corresponding cylinder.

A fuel injection valve 21 is provided to a top of each cylinder of the engine 11 to directly inject fuel into the cylinder. A spark plug 22 is provided to each cylinder at a cylinder head of the engine 11 to ignite the fuel and air mixture contained in the cylinder through discharging of sparks from the spark plug 22. Furthermore, a variable valve timing device 39 is provided to intake valves 37 of the engine 11 to change opening/closing timing of the intake valves 37, and a variable valve timing device 40 is provided to exhaust valves 38 of the engine 11 to change opening/closing timing of the exhaust valves 38.

A coolant temperature sensor 23 is provided to a cylinder block of the engine 11 to sense the coolant temperature of the engine 11. A crank angle sensor 24 is positioned radially outward of a crankshaft (not shown) to output a crank angle signal (a pulse signal) every time the crankshaft rotates a predetermined crank angle. A crank angle and an engine rotational speed are sensed based on output pulse signals of the crank angle sensor 24.

An upstream-side catalytic converter 26 and a downstream-side catalytic converter 27 are provided in an exhaust pipe 25 of the engine 11 to purify the exhaust gas of the engine 11. Furthermore, an exhaust gas sensor 28 (e.g., an air/fuel ratio sensor, an oxygen sensor) is provided on an upstream side of the upstream-side catalytic converter 26 to sense an air/fuel ratio or a rich/lean state of the exhaust gas. Furthermore, a pedal position (an accelerator opening degree) of an accelerator pedal 35 is sensed with an accelerator sensor 36.

An output of each of the above sensors is supplied to an engine control circuit (hereinafter referred to as "ECU") 30. The ECU 30 has a microcomputer as its main component. When each corresponding routine (described below), which is stored in a ROM (a storage medium) of the ECU 30, is executed, the ECU 30 sets a target throttle opening degree in a manner that coincides an output torque of the engine 11 with a target torque (a demanded torque) to control an intake air quantity (a cylinder air charge quantity, which is a quantity of air charged in the corresponding cylinder).

Figure 2:
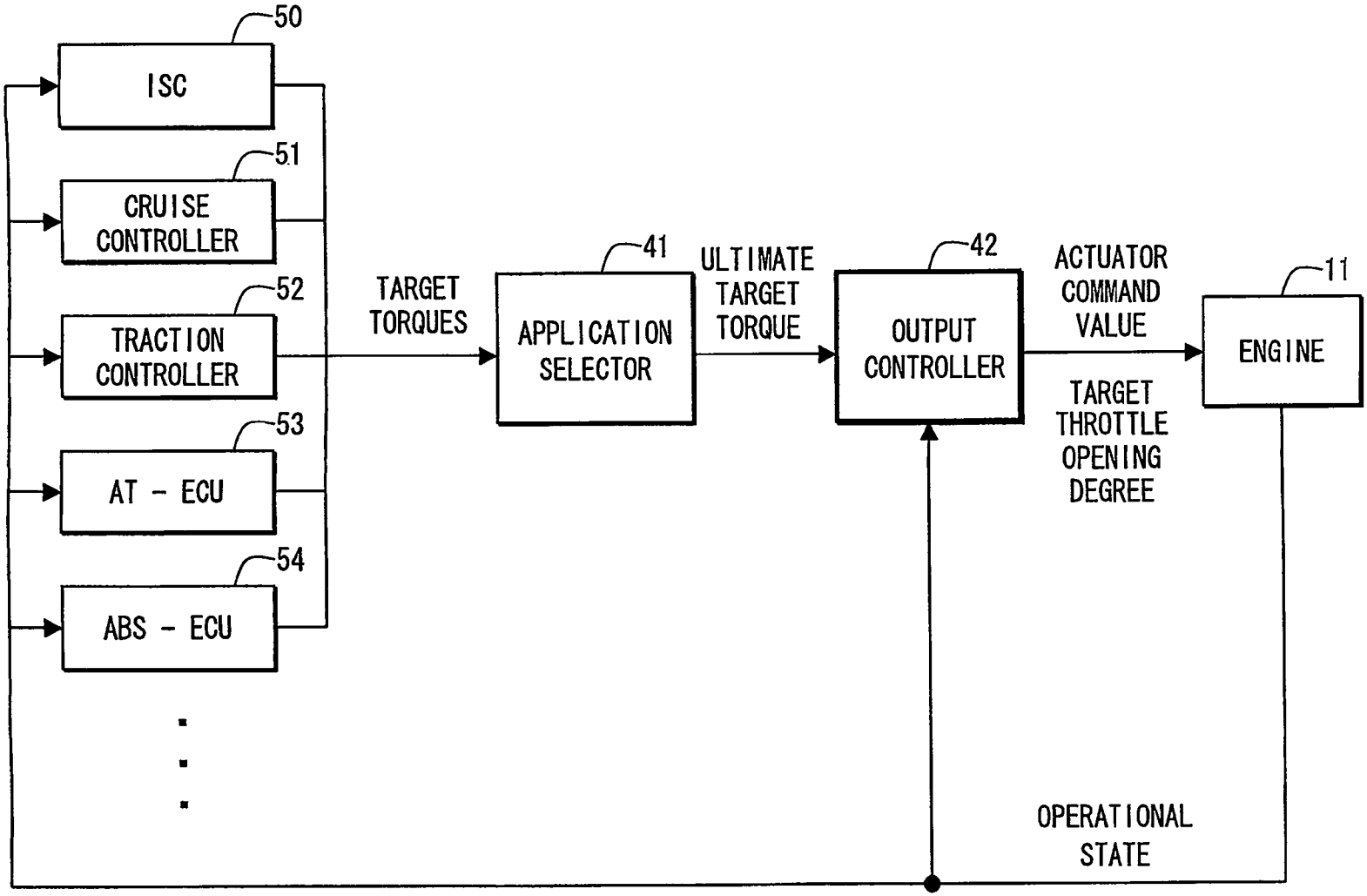
FIG. 2 is a block diagram schematically showing a vehicle control system.

In the present embodiment, as shown in FIG. 2, a target torque is set by each of, for example, an idle speed controller (ISC) 50, a cruise controller 51, a traction controller 52, an automatic transmission control apparatus (AT-ECU) 53 and an antilock-brake system control apparatus (ABS-ECU) 54. Then, an application selector (application selecting means) 41 selects an ultimate target torque from these target torques. Thereafter, an output controller (output control apparatus or output controlling means) 42 computes an actuator command value (a target throttle opening degree) based on the ultimate target torque and outputs the computed actuator command value to the engine 11 to coincide the output torque of the engine 11 with the target torque.

Figure 3:
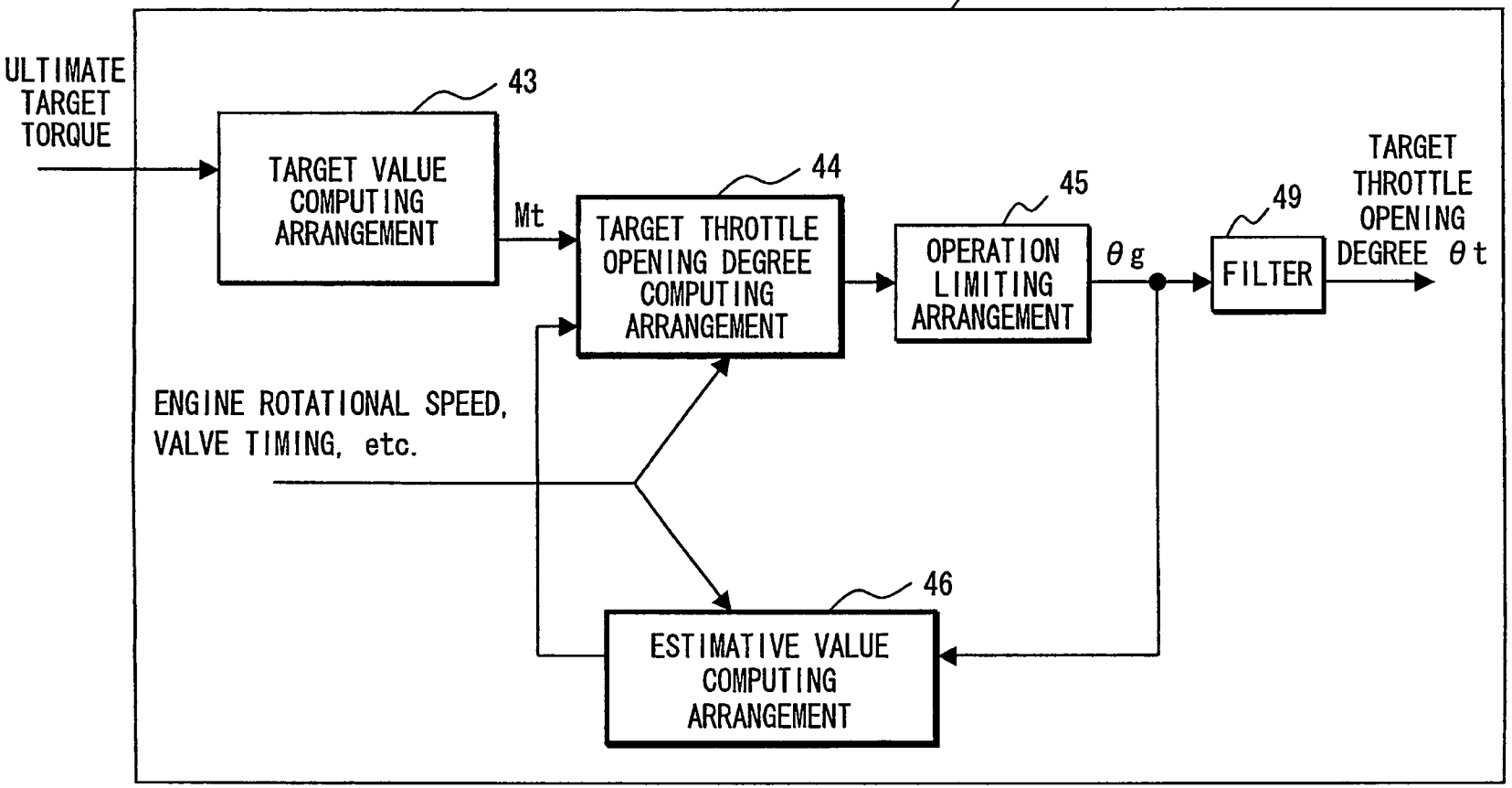
FIG. 3 is a block diagram showing an output controller of the present embodiment.

As shown in FIG. 3, the output controller 42 includes a target value computing arrangement (target value computing means) 43, a target throttle opening degree computing arrangement (target throttle opening degree computing means) 44, an operation limiting arrangement (operation limiting means) 45 and an estimative value computing arrangement (estimative value computing means) 46. The target value computing arrangement 43, the target throttle opening degree computing arrangement 44, the operation limiting arrangement 45 and the estimative value computing arrangement 46 form a target throttle opening degree computing device, which computes a target throttle opening degree θg described below based on the ultimate target torque. Specifically, the target value computing arrangement 43 converts the ultimate target torque to a target cylinder air charge quantity Mt, which is a target air charge quantity that is charged in the corresponding cylinder. The target throttle opening degree computing arrangement 44 computes a target throttle opening degree based on the target cylinder air charge quantity Mt. The operation limiting arrangement 45 limits the target throttle opening degree in view of, for example, emissions and a drive performance of the motor 15 of the electronic throttle system through an upper and lower limit guard process and a drive speed/acceleration guard process of the throttle valve 16. The estimative value computing arrangement 46 computes an estimative value (Pmest) of the cylinder air charge quantity and an estimative value (Mtest) of the intake air pipe pressure, which can be achieved with the target throttle opening degree θg, which is limited by the operation limit process (the guard processes).

Figure 5:
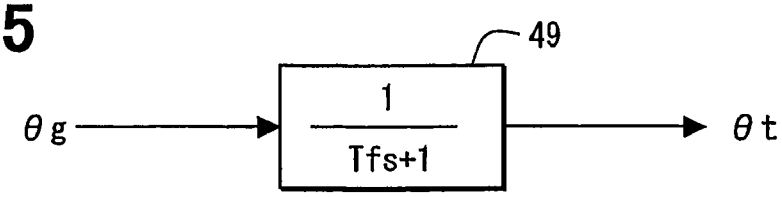
FIG. 5 is a block diagram showing a transfer function of a filter of the output controller.

The output controller 42 further includes a filter 49, which filters fluctuations (noise) of the target throttle opening degree θg, which is limited by the operation limiting arrangement 45 through the operation limiting process (the guard processes). In this instance, no filter is applied to influential operational parameters (e.g., the engine rotational speed and the valve timing), which may have a substantial influence on the target cylinder air charge quantity Mt and/or a charging efficiency η that serve as the input to the target throttle opening degree computing arrangement 44. Furthermore, the filter 49, which filters the fluctuations (the noise) of the target throttle opening degree θg, is placed outside of a closed loop that includes the target throttle opening degree computing arrangement 44, the operation limiting arrangement 45 and the estimative value computing arrangement 46. As shown in FIG. 5, the filter 49 is expressed by a transfer function of a first-order lag, i.e., Transfer Function of Filter 49=1/(Tfs+1), where "Tf" denotes a time constant of the filter 49.

The throttle opening degree is controlled based on a filtered target throttle opening degree (ultimate target throttle opening degree) θt, from which the fluctuations (the noise) are filtered by the filter 49.

Figure 4:
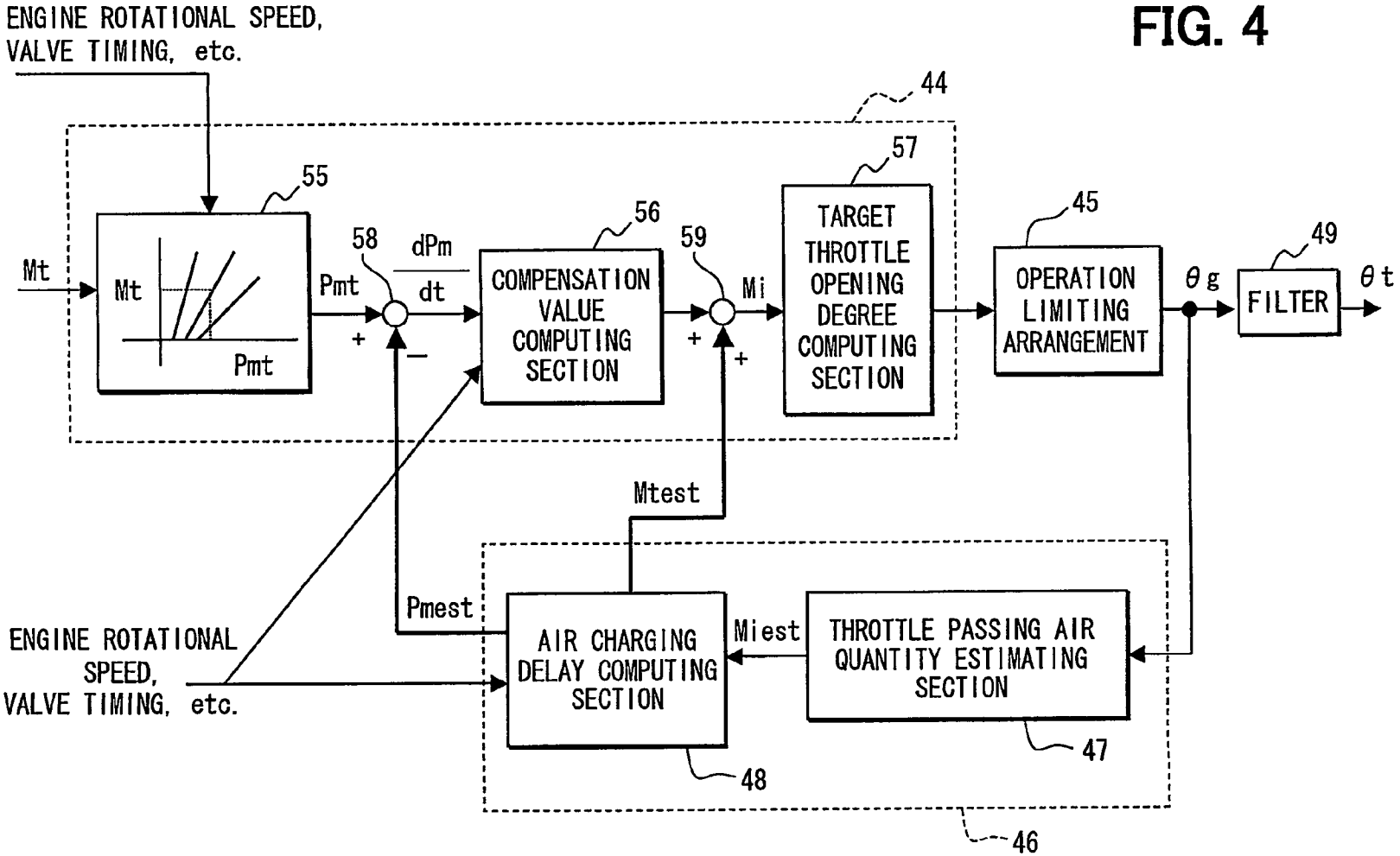
FIG. 4 is a block diagram showing details of a target throttle opening degree computing arrangement and an estimative value computing arrangement of the output controller.
Figure 8:
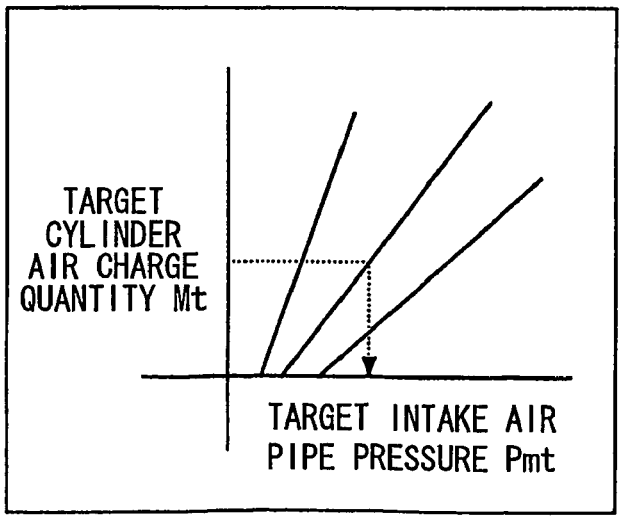
FIG. 8 is a diagram showing a map of the embodiment, which is used to convert a target cylinder air charge quantity Mt to a target intake air pipe pressure Pmt.

Based on the fact that the intake air pipe pressure Pm and the cylinder air charge quantity have a generally linear relationship with each other, as shown in FIG. 4, the target throttle opening degree computing arrangement 44 computes a target intake air pipe pressure Pmt, which is required to achieve the target cylinder air charge quantity Mt, based on a map (see FIG. 8) that uses the target cylinder air charge quantity Mt as a parameter. This is performed by a target intake air pipe pressure computing section 55 of the target throttle opening degree computing arrangement 44. The relationship between the intake air pipe pressure Pm and the cylinder air charge quantity changes according to the engine operational condition, such as the engine rotational speed and the intake/exhaust valve timing. Thus, the map, which is used to convert the target cylinder air charge quantity Mt to the target intake air pipe pressure Pmt, also uses the engine operational condition, such as the engine rotational speed and/or the intake/exhaust valve timing, as a parameter(s).

Then, a surge tank charging delay compensation value is computed through use of the following equation 1 in a compensation value computing section 56. The surge tank charging delay compensation value is a value that is used to compensate a delay (a surge tank charging delay) in the intake air from the throttle valve 16 to the surge tank 18. As indicated in the following equation 1, the surge tank charging delay compensation value is obtained by multiplying a gain (V/κ·R·Tmp) with a time derivative value (dPm/dt) of a difference dPm (=Pmt−Pmest) between the target intake air pipe pressure Pmt and the estimative intake air pipe pressure Pmest. This difference dPm is previously obtained at a subtracter 58.

TANK CHARGING DELAY (Equation 1)

$$\text{COMPENSATION VALUE} = \frac{v}{\kappa \cdot R \cdot Tmp} \cdot \frac{dPm}{dt}$$

$$\left(\frac{dPm}{dt} = \frac{Pmt - Pmest}{dt}\right)$$

Here, "κ" denotes an intake air specific heat ratio, and "R" denotes an Intake air gas-law constant. Furthermore, "Tmp" denotes an intake air temperature, and "V" denotes a volume of an air passage from the throttle valve 16 to the surge tank 18.

Furthermore, as expressed by the following equation 2, the target throttle opening degree computing arrangement 44 obtains a throttle passing air quantity Mi, which is a quantity of the intake air that passes the throttle valve 16, by adding the estimative cylinder air charge quantity Mtest, which is computed by the estimative value computing arrangement 46, to the surge tank charging delay compensation value at an adder 59.

$$Mi = Mtest + \frac{v}{\kappa \cdot R \cdot Tmp} \cdot \frac{dPm}{dt} \quad \text{(Equation 2)}$$

The above equation 2 expresses an inverse model of an intake air system model, which simulates the charging delay of the intake air, which has passed the throttle valve 16.

Then, based on the throttle passing air quantity Mi, a target throttle opening degree, which is required to achieve the throttle passing air quantity Mi, is computed by a target throttle opening degree computing section 57 of the target throttle opening degree computing arrangement 44. Thereafter, this computed target throttle opening degree is limited by the operation limiting arrangement 45 through the predetermined operation limiting process (the upper and lower limit guard process and the drive speed/acceleration guard process of the throttle valve 16) to obtain a limited target throttle opening degree θg. Next, the limited target throttle opening degree θg is filtered by the filter 49 in the filtering process (a first order lag process) to filter the fluctuations (the noise) from the limited target throttle opening degree θg and thereby to determine an ultimate target throttle opening degree et. Then, this ultimate target throttle opening degree θt is outputted to a motor drive circuit (not shown) of the electronic throttle system to drive the drive motor 15.

The estimative value computing arrangement 46 includes a throttle passing air quantity estimating section (throttle passing air quantity estimating means) 47 and an air charging delay computing section (air charging delay computing means) 48. The throttle passing air quantity estimating section 47 estimates a throttle passing air quantity Miest, which can be achieved with the target throttle opening degree θg that is limited by the operation limiting arrangement 45. The air charging delay computing section 48 computes the estimative cylinder air charge quantity Mtest and the estimative intake air pipe pressure Pmest based on the estimative throttle passing air quantity Miest through use of the intake air system model, which simulate the charging delay of the intake air, which has passed the throttle valve 16. The throttle passing air quantity estimating section 47 computes the estimative throttle passing air quantity Miest through use of the following equation 3.

$$Miest = \frac{\mu \cdot Pa \cdot \phi}{\sqrt{R \cdot Tmp}} \cdot At \quad \text{(Equation 3)}$$

Here, "μ" denotes a flow quantity adaptation coefficient, and "Pa" denotes the atmospheric pressure. Furthermore, "φ" denotes a flow quantity coefficient (or simply referred to as "flow coefficient"), which is determined by a ratio (Pmest/Pa) between the estimative intake air pipe pressure Pmest and the atmospheric pressure Pa (see FIG. 9). Also, "At" denotes a throttle opening cross sectional area, which corresponds to the target throttle opening degree θt.

The air charging delay computing section 48 computes the estimative intake air pipe pressure Pmest based on the estimative throttle passing air quantity Miest through use of the intake air system model, which is expressed by the following equation 4.

$$\frac{dPmest}{dt} = \frac{\kappa \cdot R \cdot Tmp}{V}(Miest - Mtestold) \quad \text{(Equation 4)}$$

$$dPmest = Pmest - Pmestold$$

$$= dt \cdot \frac{\kappa \cdot R \cdot Tmp}{V}(Miest - Mtestold)$$

$$Pmest = Pmestold + dt \cdot \frac{\kappa \cdot R \cdot Tmp}{V}(Miest - Mtestold)$$

Here, "Pmestold" denotes a previous estimative intake air pipe pressure, and "Mtestold" denotes a previous estimative cylinder air charge quantity. Furthermore, "dt" denotes a computation cycle (computation period).

Figure 11:
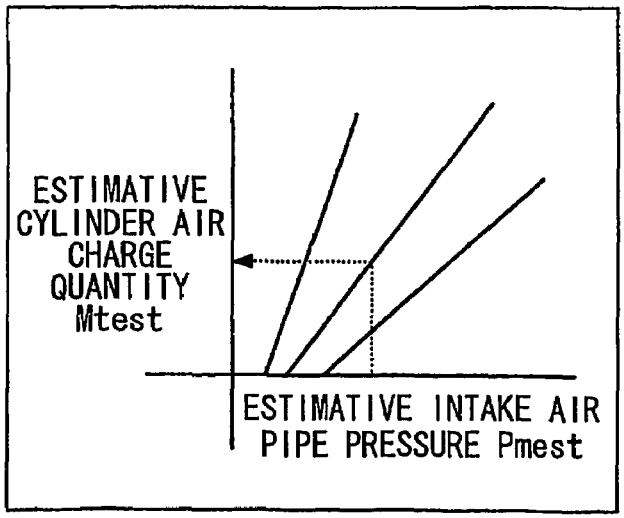
FIG. 11 is a diagram showing a map of the embodiment, which is used to convert an estimative intake air pipe pressure Pmest to an estimative cylinder air charge quantity Mtest.

Through use of the equation 4, after computation of the current estimative intake air pipe pressure Pmest, the estimative cylinder air charge quantity Mtest, which corresponds to the computed current estimative intake air pipe pressure Pmest, is computed through use of a map (see FIG. 11). Here, the relationship between the estimative intake air pipe pressure Pmest and the estimative cylinder air charge quantity Mtest changes according to the engine operational condition, such as the engine rotational speed and the intake/exhaust valve timing. Thus, the map, which is used to convert the estimative intake air pipe pressure Pmest to the estimative cylinder air charge quantity Mtest, also uses the engine operational condition, such as the engine rotational speed and the intake/exhaust valve timing, as the parameter(s).

Figure 6:
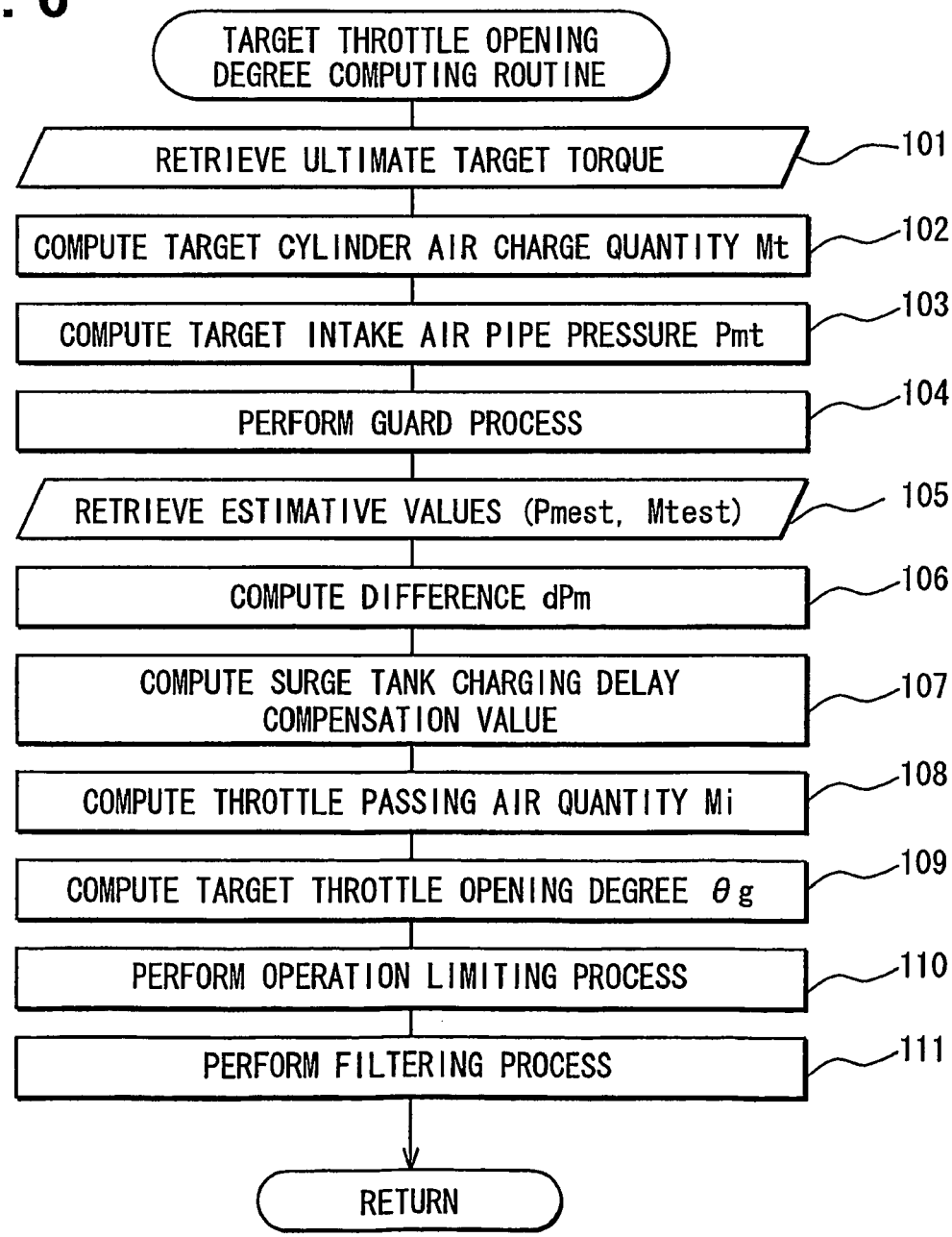
FIG. 6 is a flowchart showing a target throttle opening degree computing routine of the embodiment.
Figure 7:
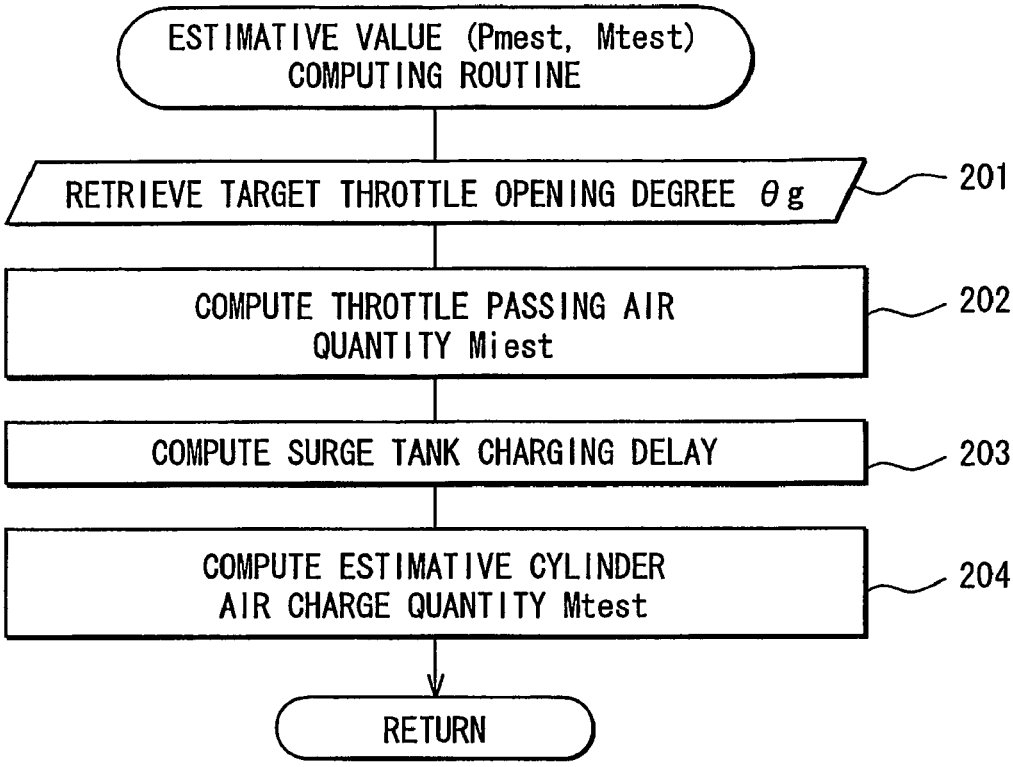
FIG. 7 is a flowchart showing an estimative value (Pmest, Mtest) computing routine of the embodiment.

The above described throttle control operation is executed by the ECU 30 according to the routines shown in FIGS. 6 and 7. Hereinafter, details of each of these routines will be described.

First, with reference to FIG. 6, a target throttle opening degree computing routine, which is executed at predetermined intervals during the operation of the engine, will be described. Upon starting of this routine, the ultimate target torque, which is selected by the application selector 41, is retrieved at step 101. Then, at step 102, the target cylinder air charge quantity Mt is computed based on the current engine rotational speed NE and the ultimate target torque through use of a two dimensional map. Thereafter, at step 103, the target intake air pipe pressure Pmt, which is required to achieve the target cylinder air charge quantity Mt, is computed through use of the map (see FIG. 8), which uses the target cylinder air charge quantity Mt as the parameter. Here, the relationship between the intake air pipe pressure Pm and the cylinder air charge quantity changes according to the engine operational condition, such as the engine rotational speed and the intake/exhaust valve timing. Thus, the map (see FIG. 8), which is used to convert the target cylinder air charge quantity Mt to the target intake air pipe pressure Pmt, also uses the engine operational condition, such as the engine rotational speed and/or the intake/exhaust valve timing, as the parameter(s).

Thereafter, at step 104, a guard process (or atmospheric pressure compensation) is performed on the target intake air pipe pressure Pmt in such a manner that the target intake air pipe pressure Pmt falls within an achievable intake air pipe pressure range, which can be achieved under the current atmospheric pressure condition. Then, at step 105, the estimative intake air pipe pressure Pmest and the estimative cylinder air charge quantity Mtest, which are computed in an estimative value (Pmest, Mtest) computing routine of FIG. 7 described below, are retrieved. Next, at step 106, the difference dPm (=Pmt−Pmest) between the target intake air pipe pressure Pmt and the estimative intake air pipe pressure Pmest is computed.

Thereafter, at step 107, the surge tank charging delay compensation value, which is required to perform the phase lead compensation on the difference dPm by the amount that corresponds to the delay (the surge tank charging delay) of the intake air from the throttle valve 16 to the surge tank 18, is computed through use of the equation 1. Then, at step 108, the throttle passing air quantity Mi is obtained by adding the estimative cylinder air charge quantity Mtest to the surge tank charging delay compensation value.

Then, at step 109, based on the throttle passing air quantity Mi, the target throttle opening degree Et, which is required to achieve the throttle passing air quantity Mi, is computed as follows. First, a required throttle opening cross sectional area At, which is required to achieve the throttle passing air quantity Mi, is computed through use of the following equation 5.

$$At = Mi \cdot \frac{\sqrt{R \cdot Tmp}}{\mu \cdot Pa \cdot \phi} \qquad \text{(Equation 5)}$$

Figure 9:
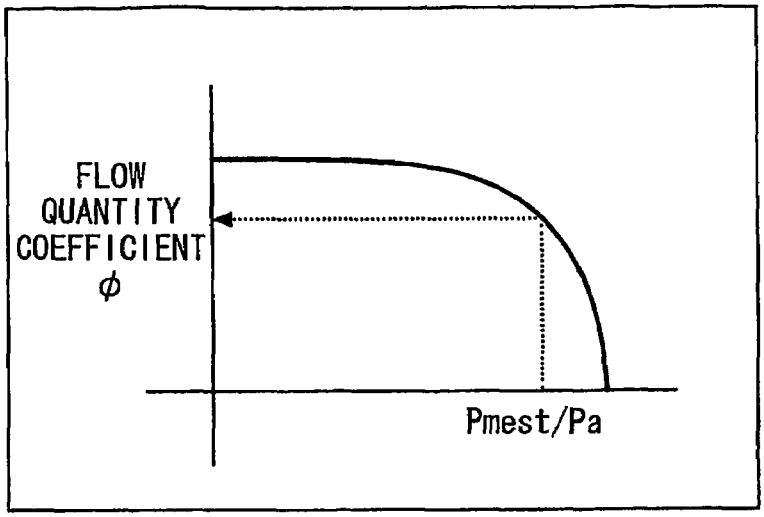
FIG. 9 is a diagram showing a map of the embodiment, which is used to compute a flow quantity coefficient $\phi$ based on a ratio (Pmest/Pa) between an estimative intake air pipe pressure Pmest and an atmospheric pressure Pa.

Here, the flow quantity coefficient $\phi$ is computed based on the ratio (Pmest/Pa) between the estimative intake air pipe pressure Pmest and the atmospheric pressure Pa through use of, for example, the map shown in FIG. 9.

Figure 10:
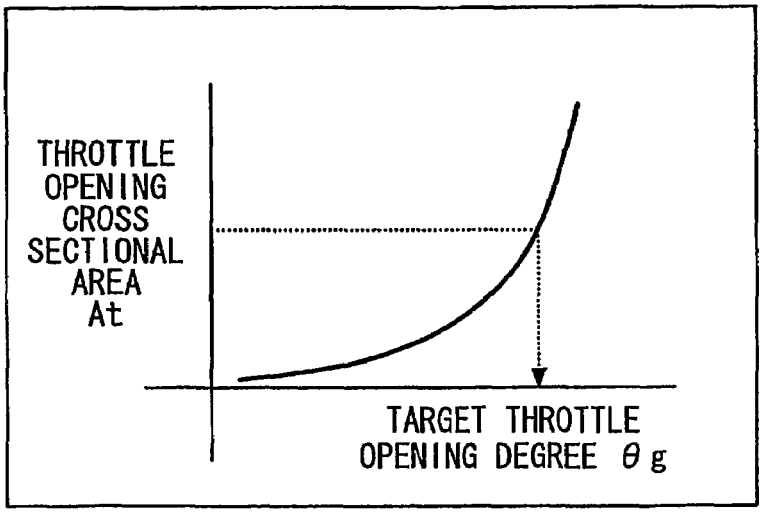
FIG. 10 is a diagram showing a map of the embodiment, which is used to convert a throttle opening cross sectional area At to a target throttle opening degree $\theta t$.

The throttle opening cross sectional area At, which is computed through the above equation 5, is converted to the target throttle opening degree $\theta g$ through use of, for example, a map shown in FIG. 10.

Next, at step 110, the target throttle opening degree $\theta g$ is limited through the predetermined operation limiting process (the upper and lower limit guard process and the drive speed/acceleration guard process of the throttle valve 16). Thereafter, at step 111, the limited target throttle opening degree $\theta g$, which is limited by the operation limiting process, is filtered by the filter 49 in the filtering process (the first order lag process) to filter the fluctuations (the noise) from the limited target throttle opening degree $\theta g$ to determine the ultimate target throttle opening degree $\theta t$.

Now, with reference to FIG. 7, the estimative value (Pmest, Mtest) computing routine, which is executed at predetermined intervals during the operation of the engine, will be described. Upon starting of this routine, at step 201, the current target throttle opening degree $\theta g$, which is limited through the predetermined operation limiting process, is retrieved. Then, at step 202, the throttle passing air quantity Miest, which can be achieved with this target throttle opening degree $\theta g$, is estimated. At this time, the target throttle opening degree $\theta g$ is converted to the throttle opening cross sectional area At through use of the map similar to the map shown in FIG. 10, and the estimative throttle passing air quantity Miest is computed based on this throttle opening cross sectional area At through use of the equation 3.

Thereafter, at step 203, an intake air pipe pressure change amount dPmest, which is an amount of change in the intake air pipe pressure per computation cycle dt, is computed based on a difference (Miest−Mtestold) between the current estimative throttle passing air quantity Miest and the previous estimative cylinder air charge quantity Mtestold through use of the equation 4, which simulates the surge tank charging delay. Then, the intake air pipe pressure change amount dPmest per computation cycle dt is added to the previous estimative intake air pipe pressure Pmestold to obtain the current estimative intake air pipe pressure Pmest.

Then, at step 203, the estimative cylinder air charge quantity Mtest, which corresponds to the estimative intake air pipe pressure Pmest, is computed through use of, for example, the map (see FIG. 11). Here, the relationship between the estimative intake air pipe pressure Pmest and the estimative cylinder air charge quantity Mtest changes according to the engine operational condition, such as the engine rotational speed and the intake/exhaust valve timing. Thus, the map (see FIG. 11), which is used to convert the estimative intake air pipe pressure Pmest to the estimative cylinder air charge quantity Mtest, also uses the engine operational condition, such as the engine rotational speed and/or the intake/exhaust valve timing, as the parameter(s).

Next, advantages of the present embodiment will be described with reference to FIGS. 12A to 12C.

Figure 12A:
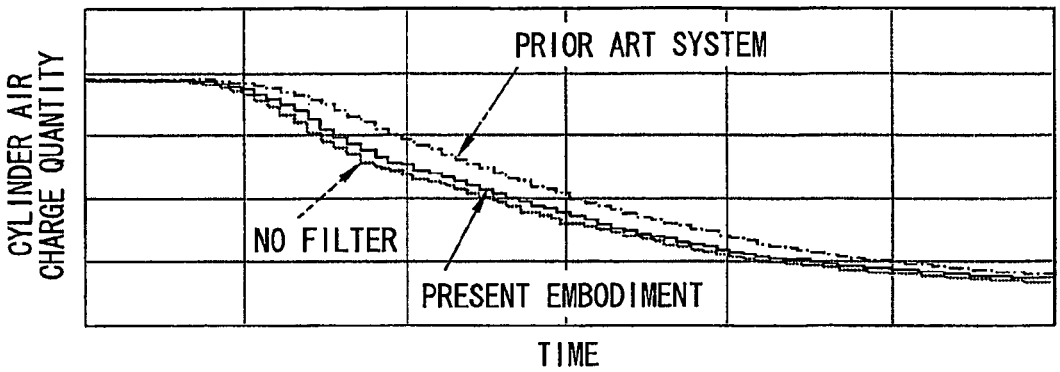
FIG. 12A is a time chart showing a change in a cylinder air charge quantity in view of time in a moderate operational transition period.
Figure 12B:
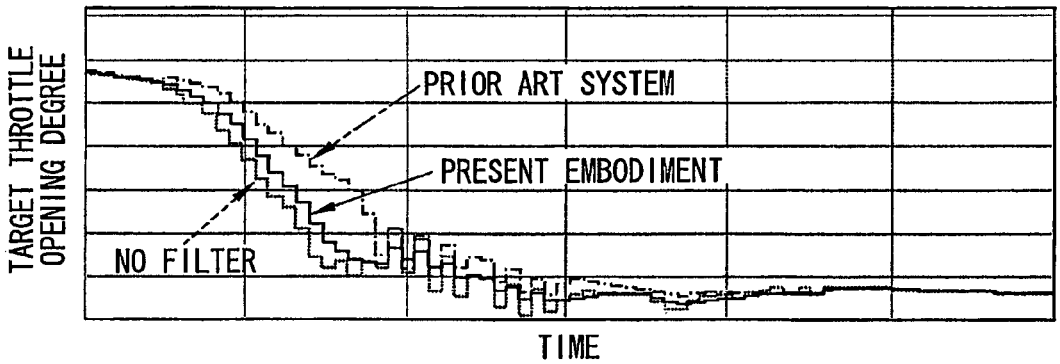
FIG. 12B is a time chart showing a change in a target throttle opening degree in view of time in the moderate transient operational period.
Figure 12C:
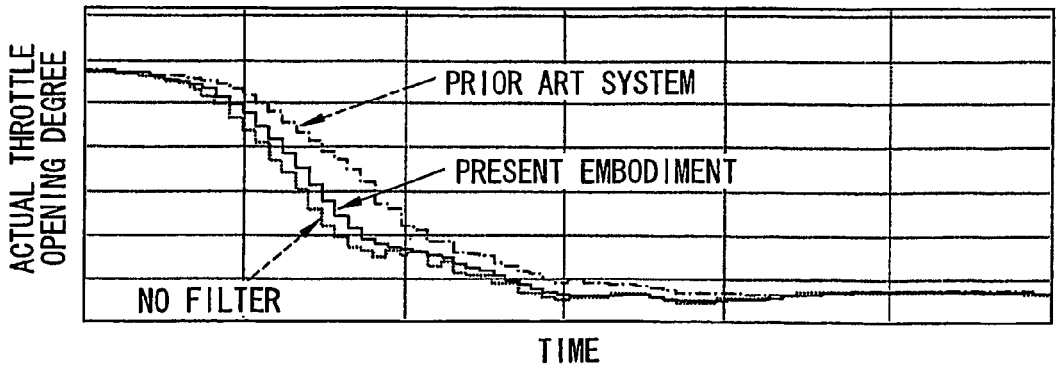
FIG. 12C is a time chart showing a change in an actual throttle opening degree in view of time in the moderate operational transition period.

FIGS. 12A to 12C show time charts, which indicate the control characteristics in a moderate transient operational period of the engine and compare a prior art filtering case (prior art system), a final stage filtering case (the case of the present embodiment) and a non-filtering case (no filter). In the prior art filtering case, the filter is applied on the input (e.g., the target cylinder air charge quantity Mt) of the control system. In the final stage filtering case of the present embodiment, the filter is applied to the output (the target throttle opening degree) of the control system. In the non-filtering case, a filter is not applied to the control system at all.

In the control system, which controls the throttle opening degree (the cylinder air charge quantity), the phase lead compensator, which compensates the charging delay of the intake air, which has passed the throttle valve 16, is provided. Thus, in the case where the filter is not provided to the control system at all, when the noise is added to the input of this control system, the target throttle opening degree shows the hunting in the moderate transient operational period due to the action of the phase lead compensator, as shown in FIG. 12B, so that the target throttle opening degree becomes unstable.

In order to address this disadvantage, in the prior art system, the filter is applied to the input of the control system. However, in the prior art system, besides the target cylinder air charge quantity, the input, to which the filter is applied, further includes various operational parameters (e.g., the engine rotational speed and the valve timing), which may have the substantial influence on the charging efficiency $\eta$. Thus, when the filter is applied to each of these hunting factors of the input, which causes the hunting, the multiple filters are applied to the input, so that the response is retarded.

Unlike the above cases, according to the present embodiment, instead of providing the filter to the input side of the control system, the filter 49 is positioned between the phase lead compensator and the control subject, i.e., is positioned on the output side of the control system. Specifically, in the present embodiment, the input side filter, which causes the deterioration of the response, is eliminated in view of the finding that the fluctuations encountered during the computation will not cause a significant problem even when the filter is not applied to the input of the control system, and the filter is provided only to the output side of the control system to filter the fluctuations of the target throttle opening degree and thereby to stabilize the control system. According to the present embodiment, the single filter 49 is sufficient to filter the fluctuations of the target throttle opening degree. Thus, in comparison to the prior art system, which applies the filter to each of the hunting factors, the delay in the response caused by the filtering is reduced according to the present embodiment. Therefore, even in the moderate transient operational period, the hunting of the target throttle opening degree can be advantageously limited while maintaining the good response of the control system. As a result, the good response and the good stability of the control system can be both achieved. In this way, the improved fuel consumption, the increased durability of the electronic throttle system, and the improved drivability of the vehicle can be achieved.

In the control system, which has the closed loop, like in the present embodiment, when the filter is provided in the closed loop, an apparent phase lead compensation gain increases to improve the response. However, the output (the target throttle opening degree) of the control system disadvantageously becomes overshooting relative to the excessive stepwise changes.

In contrast to this, in the present embodiment, the filter 49 is placed outside of the closed loop. Therefore, it is possible to advantageously limit the overshooting of the output (the target throttle opening degree) of the control system even with respect to the excessive stepwise changes of the control system, which has the closed loop.

Furthermore, according to the present embodiment, the estimative cylinder air charge quantity (Mtest) and the estimative intake air pipe pressure (Pmest) are computed in view of the charging delay of the intake air based on the target throttle opening degree, which is limited by the predetermined operation limiting arrangement 45 through the operation limiting process. Then, the difference dPm (=Pmt−Pmest) between the target value Pmt of the intake air pipe pressure and the estimative valve Pmest of the intake air pipe pressure is computed. Thereafter, the difference dPm is compensated through the phase lead compensation by the amount that corresponds to the charging delay of the intake air to obtain the throttle passing air quantity Mi. Next, the target throttle opening degree is computed based on the throttle passing air quantity Mi. This target throttle opening degree is limited through the operation limiting process in view of, for example, the emissions. Thus, when the target cylinder air charge quantity Mt shows the stepwise changes, the target throttle opening degree will be gradually decreased with a moderate inclination to the corresponding target throttle opening degree, which is set for the steady operational period that occurs after the stepwise changes instead of showing a rapid temporal increase and a subsequent rapid decrease to the corresponding target throttle opening degree. Thus, when the target cylinder air charge quantity Mt shows the stepwise changes, the target throttle opening degree, which is limited through the operation limiting process, will only show the moderate overshooting beyond the target throttle opening degree, which is set for the steady operational period after the stepwise changes. In this way, the response of the actual cylinder air charge quantity relative to the target cylinder air charge quantity Mt, which shows the stepwise changes, is increased.

The present invention is not limited to the control system, which has the closed loop, and may be applied to any other suitable control system, which has no closed loop. In the control system, which has no closed loop, the position of the operation limiting arrangement 45 and the position of the filter 49 may be reversed. Specifically, the target throttle opening degree, which is computed by the target throttle opening degree computing arrangement 44, may be filtered through the filtering process and may be then limited through the operation limiting process. That is, the filter may be positioned anywhere between the phase lead compensator and the control subject.

The present invention is not limited to the control system, which controls the electronic throttle system as the control subject, and may be applied to any other suitable control system of the vehicle.

Additional advantages and modifications will readily occur to those skilled in the art. The invention in its broader terms is therefore not limited to the specific details, representative apparatus, and illustrative examples shown and described.

The invention claimed is:

1. A control apparatus that controls a control subject of a vehicle, the control apparatus comprising:

a phase lead compensator that performs phase lead compensation; and a noise filter that is positioned between the phase lead compensator and the control subject; wherein:

the control subject is an electronic throttle system of an internal combustion engine, which includes a throttle valve;

the control apparatus further comprises a target throttle opening degree computing device, which computes a target throttle opening degree of the throttle valve and includes the phase lead compensator;

the filter filters the target throttle opening degree of the throttle valve, which is outputted from the target throttle opening degree computing device; and the target throttle opening degree computing device includes a closed loop, in which the phase lead compensator is provided.

2. A control apparatus that controls a control subject of a vehicle, the control apparatus comprising:

a phase lead compensator that performs phase lead compensation;

a noise filter that is positioned between the phase lead compensator and the control subject; and a closed loop that performs feedback control of one of an estimative value and a sensed value of a control quantity of the control subject, wherein the filter is positioned outside of the closed loop; and wherein the closed loop includes the phase lead compensator.

3. The control apparatus according to claim 2, wherein:

the control subject is an electronic throttle system of an internal combustion engine that controls a throttle opening degree of a throttle valve in such a manner that a cylinder air charge quantity of the internal combustion engine coincides with a target cylinder air charge quantity; and the phase lead compensator compensates a charging delay of intake air, which has passed the throttle valve.

4. The control apparatus according to claim 2, wherein the filter is a phase lag compensator.

* * * * *